US005154639A

United States Patent [19]

Knoll et al.

[11] Patent Number: 5,154,639

[45] Date of Patent: Oct. 13, 1992

[54] PROTECTIVE PLUG FOR A DISTRIBUTOR STRIP UTILIZED IN TELECOMMUNICATIONS SYSTEMS

[75] Inventors: Rudolf Knoll, Berg; Peter Stoerk, Eurasburg, both of Fed. Rep. of Germany

[73] Assignee: Siemens Aktiengesellschaft, Munich, Fed. Rep. of Germany

[21] Appl. No.: 766,387

[22] Filed: Sep. 27, 1991

[30] Foreign Application Priority Data

Sep. 28, 1990 [DE] Fed. Rep. of Germany ..... 4030781

[51] Int. Cl.[5] ..... H01R 13/66

[52] U.S. Cl. ..... 439/620; 361/119

[58] Field of Search ..... 361/119, 126, 127; 439/620, 621, 622

[56] References Cited

U.S. PATENT DOCUMENTS

| | | | |
|---|---|---|---|
| 4,159,500 | 6/1979 | Baumbach et al. | 361/119 |
| 4,846,735 | 7/1989 | Telehler et al. | 361/119 |
| 4,881,255 | 11/1989 | Neuwirth et al. | 361/119 |
| 4,924,345 | 5/1990 | Siemon et al. | 439/620 |

FOREIGN PATENT DOCUMENTS

| | | |
|---|---|---|
| 3014796A1 | 10/1981 | Fed. Rep. of Germany . |
| 3813889C1 | 4/1989 | Fed. Rep. of Germany . |

*Primary Examiner*—Gary F. Paumen

*Attorney, Agent, or Firm*—Hill, Van Santen, Steadman & Simpson

[57] ABSTRACT

A housing for a protective plug including a surge arrester is composed of a pedestal-like lower portion and of an upper portion which is joined of one piece thereto via film hinges. The upper portion is preferably composed of two halves that, for closing the protective plug housing are pivoted towards one another and mechanically joined to one another by appropriate interlock elements. The lower portion contains receptacle chambers for contacts that, proceeding from a base, comprise a double spring contact downwardly in the plug-in direction and a clamp terminal in the upward direction. Three identical contacts are present that are each respectively connected via their clamp terminals to terminal pins of the surge arrester. A pin-shaped projection extends from the upper side of a distributor strip to serve as cooperating contacts for the double spring contacts. Each such contact also has a pin-shaped projection extending from the bottom side for connection to switching equipment. Also, such pin-shaped contacts may be insulation-pierce contacts. The contact element comprises an offset between the center line of the double spring contact and the actual terminal of the terminal legs of the surge arrester that are in alignment. Given receptacle chambers that are arranged offset relative to one another, the surge arrester can be introduced thereinto on a straight line without a deformation of its terminal legs adapted thereto when the individaul contact elements are introduced into the receptacle chambers in a defined, mutually turned position.

21 Claims, 2 Drawing Sheets

FIG4
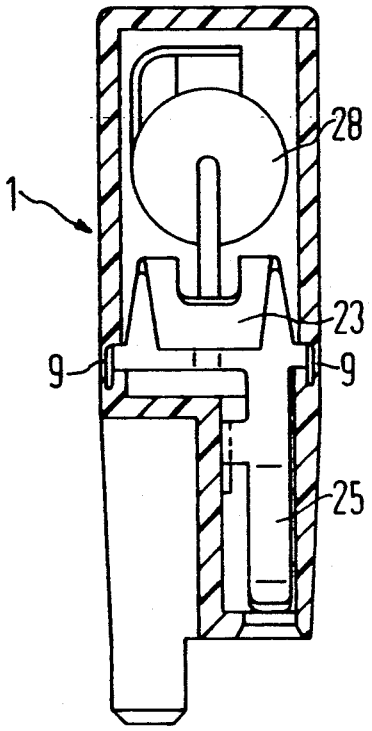
FIG5
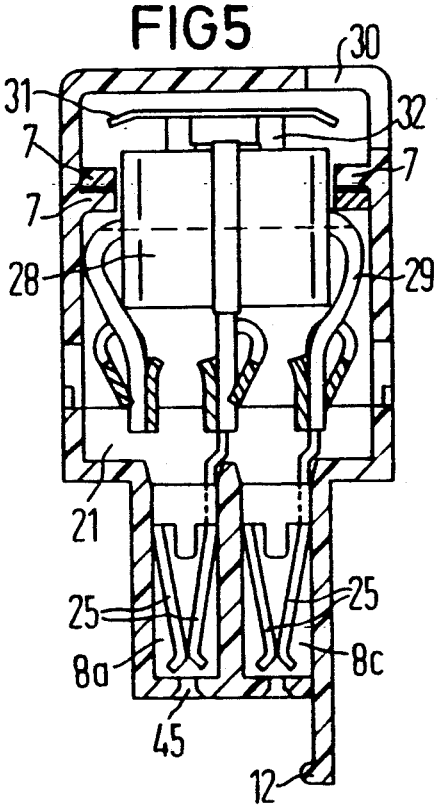
FIG6
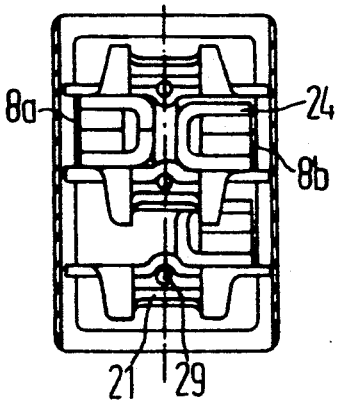
FIG7
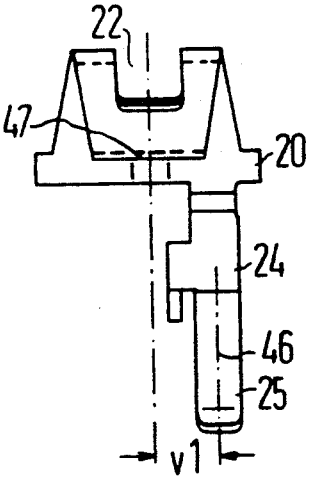
FIG8
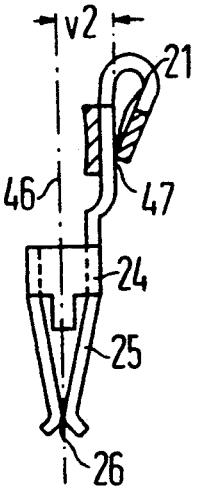
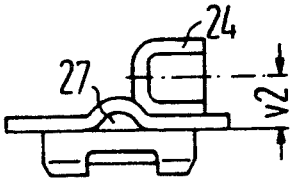
FIG9

PROTECTIVE PLUG FOR A DISTRIBUTOR STRIP UTILIZED IN TELECOMMUNICATIONS SYSTEMS

BACKGROUND OF THE INVENTION

1. Field of the Invention

The present invention relates to a protective plug for a distributor strip utilized in telecommunications systems, particularly in telephone private branch exchanges (PBXs), the protective plug containing a surge arrester whose wire-like terminal elements are connected to contact elements that are, in turn, connectible to cooperating contacts of the distributor strip after being plugged on, whereby the service side of the distributor strip comprises a plurality of terminal posts in the longitudinal direction that enable a stripping-free connection of electrical conductors.

2. Description of the Prior Art

Such cooperating contacts are usually connected to contact parts that form the contact assigned to a line in the distributor strip. The German published application 30 14 796 discloses such a protective plug that can be provided with plug tongues that can be plugged into a plug connector strip, whereby a connection between the plug tongues and the spring contacts connected to the electrical lines is produced. The protective plug is provided with surge arresters which are connected to the plug tongues. The other pole of the surge arrester is connected to a grounding rail. The protective plug comprises a plurality of receptacle chambers into which a respective surge arrester is introduced. When the protective plug is pulled, a plurality of lines of the distributor strip are without over voltage protection.

The German Letters Patent DE 38 13 889 C1, for example, has disclosed that separate protective plugs be assigned to individual line leads. The surge arrester belonging to a line lead comprises no terminal legs but is directly held with its contact locations by contact springs. These contact springs are in turn in communication with a plug-in part. The housing of the pluggable protective plug, the housing being open at one side, is closed by the plug-in tongue belonging to a grounding rail. At the same time, the electrically-conductive connection is produced from the one terminal contact location of the surge arrester to the grounding rail.

Compared to the inherently-known possibilities of providing what are referred to as protective strips or rails for the connection of the surge arresters, the utilization of such protective plugs has the advantage that no additional jumpering measures are required and that the space required for such additional protective strips is saved. A possibility for protection is optionally given with such strips even through only a relatively small portion of the subscriber lines, for example, are to be protected.

SUMMARY OF THE INVENTION

The object of the present invention is to provide a protective plug in a simple and cost-effective manner which simultaneously offers an optimum adaptation to the conditions existing upon the employment thereof in a distributor strip.

This is achieved, according to the present invention in that the insulating housing of the protective plug to be individually assigned to a pair of line leads is fashioned of one piece and is composed of a pedestal-like lower portion and an upper portion movably connected thereto. The individual receptacle chambers corresponding numerically to the plurality of terminal pins of the surge arrester are formed in the lower portion, respectively one of the contact components fashioned of one piece and identically to one another being introduced thereinto, the spatial positioning of these contact components vis-a-vis one another corresponding to that of their cooperating contact locations. Each receptacle chamber is open at both sides in the plug-in direction. That end of each contact component facing away from the cooperating contact side is fashioned as a clamp terminal into which a terminal pin of the surge arrester can be respectively plugged. The upper portion is brought by a hinge or pivot motion into a position that nearly completely surrounds the plug-in surge arrester and a mechanical joining of the housing parts to form a closed housing is undertaken with interlock elements. The contact components are fixed in position due to the design of the upper portion.

The housing parts that are already interconnected according to the present invention with, for example, a hinge-like connection can be closed in a simple procedure without great forces. The closure elements that are already integrated into the housing portions. Those portions to be accepted into the protective plug are to be introduced in an extremely assembly-friendly manner since only a single assembly direction is required therefor. Given a corresponding selection of the contact components, these are completely contained in the lower portion, so that no modification as a result of mechanical operations can occur. The housing surrounds the surge arrester, so that no additional measures for protection against accidental contact that are otherwise required are necessary. A maximum of reliability in the contacting with the cooperating contact locations of the distributor strip is achieved given a minimum of design expense. A closed force circuit exists for the contact components, i.e. the contacting force can be exerted independently of the housing. The connection between the terminal pins of the surge arrester and the contacting to the cooperating contacts of the contact components occurs without support in the direction towards the housing. This contacting is therefore also preserved if the housing were to melt off. The contact components that largely extend in a straight line can thereby be cost-effectively fashioned and simply introduced into the receptacle chambers.

Assembly is significantly simplified by a feature and development of the invention in that the upper portion is composed of two halves centrally divided in the direction of the longitudinal axis that are joined to the lower portion in the manner of a film hinge at respective, upper outside edges that lie opposite one another. When the two halves are pivoted towards one another, defined wall surfaces of the two portions at least partially overlap in the ultimate position. As a result of catch elements provided in this respective overlap region, the mechanical connection of the two halves is undertaken by the engagement of these catch elements.

When the initially-open housing that is equipped with the provided components is pulled through, for example, an assembly jig provided with through receptacles, then the closing to form a ready-to-use protective plug occurs without problems. A simple closure hook can be provided as a cache element, this being initially resiliently pressed toward the outside when the two halves are pivoted towards one another and snapping into a cutout in the ultimate position.

In particular, automated manufacture is significantly facilitated with such a construction of the protective plug of the present invention.

According to particular features of the invention, the protective plug is particularly characterized in that, with reference to a center line of a contact part of the contact component connectible to the cooperating contact that extends in the plug-in direction, the position of the clamp point for the clamp terminal thereof is defined by a specific offset both in the transverse axis as well as in the axis that, in turn, extends perpendicularly thereto and to the center line and is particularly characterized in that the receptacle chambers comprise a rectangular cross section, that the contact component respectively introduced thereinto comprises and at least U-shaped base portion adapted thereto in terms of dimensions that, in the plug-in direction in its downward extension, is fashioned as a contact part connectible to the cooperating contact and is fashioned as a clamp terminal in its upward extension.

With the design of the contact elements and receptacle chambers as just mentioned, the structure enables surge arresters to be directly clamped relative to one another in the position of the receptacle chambers given employment of identical contact elements and given different configurations, the terminal pins of the surge arresters having a spatial configuration that deviates therefrom. For example, it therefore becomes possible to plug the terminal pins arranged in a straight line into contact components that are introduced into receptacle chambers that are laterally offset relative to one another.

According to another feature of the invention, the protective plug is particularly characterized in that two axes lie in one plane that comprise a given spacing to a base part. Among the things achieved by this improvement and feature of the invention, is that a contact component can be introduced into the receptacle chamber only in specifically-defined positions. Fundamentally, the contact part of the contact component contactible to the cooperating contact can exhibit the function of a pin or of a jack or socket given a corresponding adaption of this cooperating contact. This latter embodiment contained as a feature and development of the invention has the particular advantage that fork spring contacts enabling such a jack function lie entirely within the receptacle chamber. They are therefore protected against mechanical influences. Pin-shaped projections that extend from the surface of a distributor strip serve as cooperating contacts, so that the protective plug can be plugged thereunto. Such a contact arrangement also has advantages particularly over those solutions wherein pins or, respectively, tongues emerging from the protective plug are pushed between the poles of, for example, the separating contacts introduced into the distributor strip. No influencing whatsoever of these contact junctions designed in view of line lead conditions occurs.

According to another feature and development of the invention, the protective plug is respectively equipped with a surge arrester that comprises three-wire-like terminal pins that are each separately allocated to a respective line lead pair and to a grounding connection and that are plugged into the clamp terminals of the contact components introduced into three separate receptacle chambers.

The chambers for the contact parts contained in the distributor strips are arranged in a defined grid in the distributor strips. In a specific embodiment, the receptacle chambers are not arranged in a line, but are offset relative to one another in agreement with the division spacing prescribed by such a grid. When, for example, these chambers are defined by the corner points of a triangle, the terminal pins of the three-pole surge arrester that themselves are aligned in a line in the plane of the center axis of its long side can be directly plugged into the clamp terminals of the contact components without any additional deformation. This occurs in that the contact components equipped in conformity with that mentioned above with respect to reference to a center line of the contact part and a position of a clamp point for the clamp terminal being defined by a specific offset in the transverse direction and the contact component having a U-shaped portion adapted in terms that, in the plug-in direction in its downward extension being fashioned as a contact part which is contactible to the cooperable contact and fashioned as a clamp terminal in its upward extension, and with respect to the two axes lying in one plane that comprises or provides a given spacing to a base part, the base part is adapted to the cross-sectional dimensions of the receptacle chamber, and the contact components are introduced in a position turned relative to one another such that the respective clamp points of the clamp terminals assume a mutually-aligning position. This occurs, for example, in that the contact component introduced into the chamber arranged laterally offset has its clamp terminal facing towards the clamp terminals of the two other contact components. This occurs on the basis of a position turned by 180°. A conversion of the terminal points arranged in a line therefore occurs directly onto the receptacle chambers arranged in the triangle. No adaptation whatsoever of the terminal pins of the surge arrester in accordance with the spatial position of the receptacle chambers therefore need be undertaken relative to one another. Furthermore, no additional guideways need be provided in the housing for these terminal pins. As a result of this conversion possibility from line to triangular shape, the contact components in the protective plug can be accommodated in tight proximity. A protective plug that, as already mentioned, is separately assigned to a line lead pair can therefore be realized in the most simple manner even for strips that are fashioned extremely narrow and have an extremely small division spacing for the chambers contained therein.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 4 is a sectional view taken substantially along the parting line IV—IV of FIG. 5;

FIG. 5 is a sectional view taken substantially along the parting line V—V of FIG. 4;

FIG. 6 is a sectional view taken substantially along the parting line VI—VI of FIG. 5;

FIG. 7 is an elevational view of the contact employed in practicing the present invention;

FIG. 8 is a side view, shown partially in section along the parting line VIII—VIII of FIG. 7; and FIG. 9 is a top view of the contact of FIGS. 7 and 8.

DESCRIPTION OF THE PREFERRED EMBODIMENTS

Figure 1:
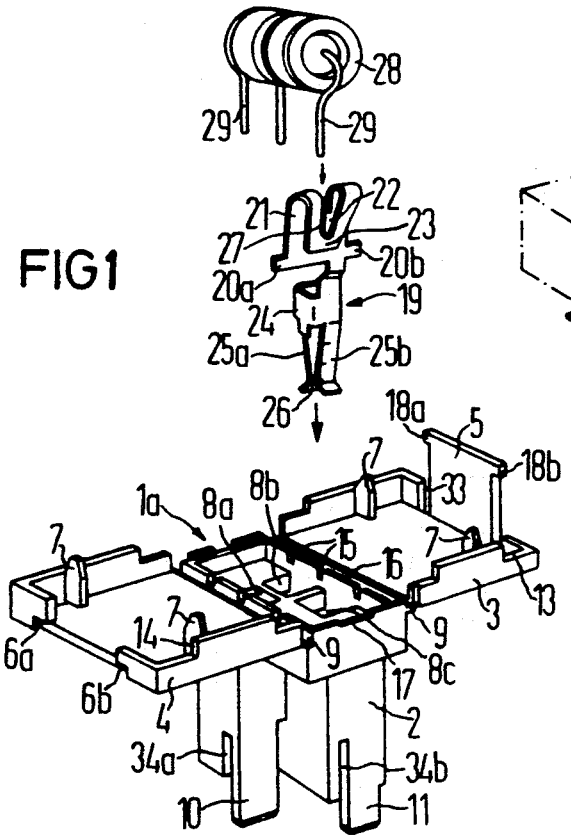
FIG. 1 is an exploded perspective view of a protective plug constructed in accordance with the present invention.

Referring to the exploded view of FIG. 1, shows contacts 19 which are introduced into the receptacle chambers 8*a*–8*c* located in the lower portion 2 of the housing 1*a*. These contacts 19, to be set forth in greater detail below, comprise a forked spring contact in the downward direction extending from a base portion 24. This forked spring contact is composed of two contact legs 25*a* and 25*b* that extend toward one another and form a contact location 26. At the top, the contact 19 comprises a clamp terminal 21. Each of the identical contacts 19 is introduced into one of the chambers 8*a*–8*c*, whereby the web 20*a*, 20*b* provided beneath the clamp terminal 21 is respectively completely accepted into slot-like recesses 15. The recesses 15 are provided at the upper edges of the walls that limit the individual chambers. The clamp terminal 21 that is freely accessible after the introduction of the contact component 19 comprises a cut-out 22 through which a respective terminal pin 29 is plugged between the legs of the clamp terminal that enables a clamped connection. Given the commercially-available surge arrester 28, the terminal pins 29 axially attached at each end face in the ready-to-use condition of the protective plug 1 are to be contacted to the two line leads and the middle terminal pin is to be contacted to the grounded conductor.

At its respective outer edges in the plug-in direction, the lower portion 2 of the protective plug housing is joined via what is referred to as a film hinge 9 to an upper portion half 3 or, respectively, 4 that lie opposite one another. After the equipping with the required contact components 19 and with a surge arrester 28 has been carried out, the housing can be closed in an extremely simple manner by pivoting the two upper halves 3 and 4 towards one another. The centering pegs 7 assigned to one another in the two halves are respectively positioned such that they just slide past one another when the two halves are pivoted towards one another, so that these halves can no longer move relative to one another in the closed condition. The mechanical joining of the two halves occurs with the closure hook 5 provided at the one outside edge of the upper portion half 3. So that a resilient region that is adequately long arises, a slot 33 turns the lower edge of this appertaining wall portion into the base for this closure hook 5. When pivoted towards one another, the closure hook 5 first places itself against the upper opposite edge of the other half 4. As a consequence of the existing spring action, it is pressed somewhat outwardly and has the projections 18*a* and 18*b* respectively snapping into the cutouts 6*a* and 6*b* present at the upper portion half 4. The housing is then closed to form the protective plug 1. Despite this functional division an upper housing region and a lower housing region, the housing is formed by a single molded insulator part. An automated assembly can be undertaken without problems on the basis of the described fashioning of the protective plug. Only one assembly direction is required. When the equipped housing is pulled through, for example, a corresponding opening of an assembly jig, whereby a corresponding entry bevel can be provided for the movable halves, then the halves move towards one another and close. The closure elements are thereby integrated in the upper portion halves.

The two portion halves 3 and 4 each respectively comprise a cutout 13 or, respectively, 14, so that an opening through which a visual check of the surge arrester 28 can occur remains after the closing. Pegs 10 or, respectively, 11 are provided at the lower portion 2 of the protective plug. A certain spring action being achieved for these pegs 10 and 11 by the respective slots 34*a* and 34*b* adjacent thereto. The pegs 10 and 11 have different widths so that the ready-to-use protective plug 1 can only be plugged onto the distributor strip 38 (FIG. 2) in a specifically defined position.

Figure 2:
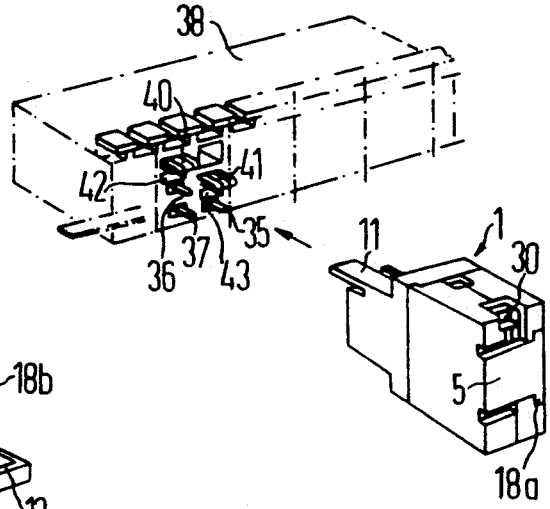
FIG. 2 is an exploded perspective view of a protective plug constructed in accordance with the present invention pluggable into a distributor strip for protecting a line lead pair.

As indicated in FIG. 2, the pegs 10 and 11 project into openings 43 and 42 whose dimensions are exactly matched to those of the pegs 10 and 11. These openings 43 and 42 can correspond to those that are present for the introduction of what is referred to as a separating plug that serves the purpose of separating parting contacts present in the strip as needed. Such parting contacts may be respective spring contacts connected to the terminals 40 and 41 (FIG. 2). At its lower end, each peg has a catch knob 12 (FIG. 5) that engages behind the lower edge of the opening at one side after plugging, as indicated at 48 in FIG. 5, so that an undesired separation of the plug-on protective plug is thereby prevented.

The schematic illustration of FIG. 2 shows those terminal locations for the distributor strip 38 that are accessible for a line lead pair extending from the servicing side. For example, what are referred to as separating contacts are provided in corresponding chambers of the distributor strip for each lead such as, for example, the a lead or, respectively, the b lead of such a line lead pair. Each of the separating contacts can be composed, for example, of two contact parts that undertake a connection through of the respective cable lead with their contact poles that lie opposite one another and are attached to the free ends thereof. The respective other end of such a contact part can be fashioned as a knife-edge post 40 (commonly known as an insulation-piercing or insulation-disrupting contact) or a similar contact post 41. The knife-edge post belonging to the one contact part, for example, can be conducted out of the distributor strip at the servicing side illustrated in FIG. 2. With reference to each line lead, the lines which may be jumpered and leading to the subscribers are connected to these terminals 40 or 41. The respective other contact part likewise comprises a knife-edge post that, however, is conducted out at the rear side opposite the servicing side. For example, the lines leading to a switching equipment can then be connected to the terminal post at the rear side. Each contact part whose terminal element fashioned, for example, as a knife-edge post which is conducted out at the rear side also simultaneously has an extension directed towards the servicing side that, as a pin-like projection 35 or, respectively, 36 passes through a corresponding opening and therefore likewise projects out at the servicing side. These pin-shaped projections that are each respectively assigned to a line lead, for example to the a lead or, respectively, to the b lead, serve as cooperating contacts for the forked spring contacts of the contact components of the protective plug 1 that, for example, are introduced into the chamber 8*a* or, respectively, 8*c*. A grounded connection is also required for the protective plug. This is enabled by the projections 37 (likewise pin-shaped) that are present in the immediate proximity of the two other pin-shaped projections. This pin-shaped projection 37 is formed for each line lead pair by a correspondingly-formed portion of a grounding plate 39. The grounding plate 39 is introduced into the distributor strip in the immediate proximity of an outside wall of the distributor strip as indicated in full in FIG. 2, whereby the projections 37 then respectively pass through corresponding openings at the servicing side. With reference to a line lead pair, this pin-shaped projection 37 then forms the cooperating contact location for, for example, the contact element 19 of the protective plug inserted into the chamber 8*b*. The contact location of the protective plug lie at one side under the knife-edge posts 40 or, respectively, 41. The protective plug 1 plugged into the pins 35–37 can have at least its one full, broad side supported against the distributor strip, the plug-in contact locations being less stressed as a result thereof. The protective plug 1 comprises a step, so that its surface that does not lie against the strip does not cover the knife-edge posts 40, 41. When such a protective plug is pulled, then only the appertaining line lead pair is without overvoltage protection.

Figure 3:
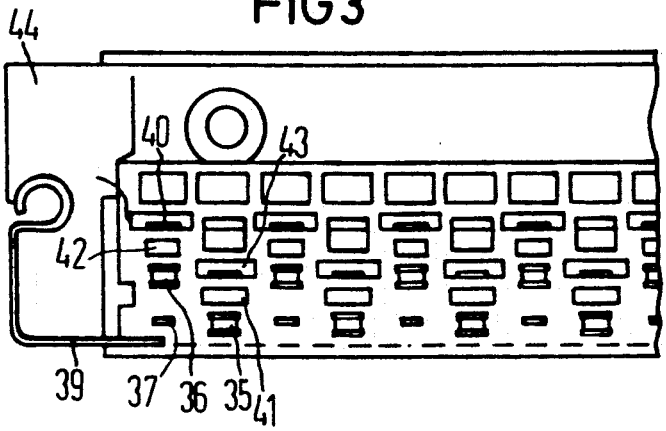
FIG. 3 is a partial plan view of the distributor strip.

It may be seen in the plan view excerpted in FIG. 3 that the terminal locations respectively assigned to a line lead pair are arranged in two rows offset relative to one another in the longitudinal direction. In this exemplary embodiment, the through openings for the pin-like projections 35–37 lie approximately at the corner points of the triangle. Accordingly, the receptacle chambers present in the protective plug 1 for the contact components to be contacted to the pin-shaped projections 35–37 are spatially allocated to one another in a manner agreeing therewith.

Upon introduction of the strip-shaped grounding plate, the projections 37 shaped like knife-edge contacts pass through the centering openings that are provided. The grounding plate 39, as may be derived from FIG. 3, is extended toward the exterior at at least one end face of the distributor strip 38 and is placed around the outside edges of a flange 44 attached to the distributor strip. Its end is bent in an eyelet-like manner and is accepted into a corresponding opening in the middle region of the flange 44. In its integrated or assembled condition, the distributor strip has this flange lying on a correspondingly-fashioned end region of an electrically-conductive, grounded carrier plate. The grounding plate is then applied to ground potential with a screwed connection to the respective carrier part that is conducted through the eyelet-like end region of the grounding plate.

FIGS. 4–6 illustrate various sectional views through the protective plug 1 equipped ready for use in an enlarged scale. The sections are thereby placed such that the design principles already set forth in the description of FIG. 1 may be seen. The surge arrester 28 has its three terminal pins 29 already clamped in the clamp terminals 19 of the respective contact component 19 in the manner already set forth. The surge arrester 28 is also equipped with an additional overcurrent protection. The solder ring 32 melts given an overcurrent, so that the shorting bar 31 drops down and places the poles of the surge arrester that are connected to the corresponding leads at ground. As already mentioned, a visual check of the surge arrester 28 is possible through the narrow window 30. As may also be seen particularly from FIG. 5, the spring contacts 25 of each contact component 19 that is introduced lie completely protected within the appertaining receptacle chamber 8. The contact pins 35–37 can pass through the respective opening 45 when the protective plug 1 is plugged in.

FIGS. 7–9 illustrate various views of the design of the contact component 19 in an enlarged scale. The critical shaping principles have already been set forth in the description with respect to FIG. 1.

The clamp terminal 21 constructed in an upward direction in a continuation of a base portion 24 arises in that this part is bent back onto itself to form a clamp line 47. A cut out 22 is provided in the bent region, the respective terminal pin 29 of the surge arrester being pluggable through the cut out 22 between the legs formed by the bent back portion and clamped at 47. A bead 27 (FIG. 1) is provided for better guidance, whereby the depth of this guide groove is less than the diameter of the terminal pin 29.

The actual clamp point of the clamp terminal 21 is offset by a spacing v1 or, respectively, v2 in two mutually-perpendicular axial directions with reference to the center line 46 of the forked spring contact. What this specific construction enables is the introduction of these completely identical contact components into the receptacle chambers and, therefore, to prescribe clamp terminal points that are arranged in alignment, even though the receptacle chambers themselves are approximately positioned at the corner points of a triangle in their positions relative to one another. As may be seen from the drawings, for example, from the corresponding sectional view of the protective plug of FIG. 6, a respective contact component 19 is introduced into the receptacle chambers 8*a* and 8*b* in coincident alignment. The contact component 19 introduced into the chamber 8*a*, by contrast, is turned in position by 180°. The clamp points for the terminal pins 29 thus lie on a straight line even though one receptacle chamber is arranged laterally offset relative to the others. A conversion of the cooperating contact locations lying on a triangle line onto a straight line arrangements of the terminals thus occurs. Given entirely identical contact components, the cooperating contact locations for the protective plug can therefore be provided in tight proximity in a small area. Specifically as a result of the design of the contact components, a protective plug can thus be realized that is separately suitable for a line lead pair given employment in distributor strips that, for example due to the position and the design of the separating contacts contained therein, can be constructed particularly narrow.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A protective plug for use with an elongate distributor strip of the type which comprises an elongate housing having a front side and a rear side and mounting a ground strip, a plurality of pairs of first contacts for connecting to respective subscriber line leads and each of said first contacts including insulation-piercing sections extending out of said front side for receiving jumper wires for subscriber line leads and out of said rear side for receiving connecting wires for switching equipment and a plurality of second contacts each associated with a respective pair of first contacts and mounted to said ground strip, and aperture means defining a pair of rectangular guide apertures of respective predetermined different cross-sectional dimensions, said protective plug comprising:

a housing including a pedestal-shaped lower housing part including upper and lower ends and a pair of spaced, opposed sidewalls extending between said upper and lower ends, each of said sidewalls including upper inner and outer edges;

a pair of upper housing parts each comprising a first wall including a first edge pivotally connected to a respective outer edge of one of said opposite side walls of said lower housing part, and a pair of opposed second walls extending perpendicular to said first wall, said first walls and said second walls forming a component cavity therebetween when said upper housing parts are pivoted together to engage corresponding ones of said second walls;

a surge arrester received in said component cavity and including first and second end terminals for connection to the respective subscriber lines and a ground terminal therebetween;

a plurality of internal walls in said lower housing part which, together with said opposed side walls define at least three contact chambers which open into said component cavity at said upper end and to the exterior at said a plurality of contacts elements, each of said contact elements mounted in a respective contact chamber and including a base member, a pair of normally-closed spring contacts extending from said base member toward said lower end for plug-on connection to a respective one of said first and second contacts of said distributor strip, and a clamp section extending from said base member opposite said pair of normally-closed spring contacts at said upper end of said lower housing part, said first, second and ground terminals of said surge arrester each clampingly received and electrically contacted in a respective clamp section;

one of said upper housing parts including a first latch member and the other of said upper housing parts including a second latch member latching to said first latch member when said upper housing parts are pivoted towards one another to form said component chamber with said surge arrester mounted therein; and a pair of guides extending from said lower housing part beyond said lower end thereof, said pair of guides including different respective rectangular cross-sectional dimensions complemental to said predetermined cross-sectional dimensions of and to be received in respective ones of said guide apertures upon plugging of said protective plug.

2. The protective plug of claim 1, wherein:

said lower housing part comprises slot means defining slots at said upper edges of said opposed sidewalls adjacent the pivotal connection of said upper housing parts thereto; and each of said contact elements comprises retaining tabs extending therefrom and received in respective ones of said slots.

3. The protective plug of claim 2, wherein:

each of said upper housing parts comprises an edge adjacent its pivotal connection to said lower housing part for engaging against said retaining tabs in the adjacent slots upon closure and latching of said upper housing parts.

4. The protective plug of claim 1, wherein:

said first latch member comprises a latch wall section and means defining at least one latch recess in said latch wall section; and said second latch member comprises a resilient projection extending from the respective upper housing part for yieldingly deflection by said latch wall section and including at least one latch tab for snapping into said at least one latch recess.

5. The protective plug of claim 1, wherein:

said first latch member comprises a latch wall section and means defining a pair of latch recesses in said latch wall section; and said second latch member comprises a resilient projection extending from the respective upper housing part for yieldingly deflection by said latch wall section and including a pair of latch tabs for snapping into said pair of latch recesses.

6. The protective plug of claim 1, and further comprising:

observation means for observing said surge arrester including means defining complementary recesses in at least two engaging ones of said second walls of said upper housing parts to provide an observation opening.

7. The protective plug of claim 1, wherein:

each of said normally-closed contacts has a first center line extending in the plug-in direction; and said clamp section has a second center line extending from said base member with said second center line offset in first and second predetermined directions from said first center line, the directions being perpendicular to one another.

8. The protective plug of claim 1, wherein:

said upper housing parts are centrally divided with respect to the center of said lower housing part with said second walls extending equal distances from the respective first wall.

9. The protective plug of claim 1, wherein:

said internal walls define each of said contact chambers to have a rectangular cross section; and said base member of each of said contact elements comprises a complemental rectangular cross section.

10. The protective plug of claim 1, wherein: said base member of each of said contact elements comprises a cross member and a pair of members extending from said cross member, said cross member bent to have a U-shaped cross section and said pair of members extending therefrom forming said normally-closed contacts.

11. The protective plug of claim 1, wherein:

said first, second and ground terminals of said surge arrester is each a wire-like terminal pin respectively assigned to a line lead and to a ground connection and are arranged in a triangular pattern; and said internal walls of said lower housing part define said contact chambers in a corresponding triangular pattern, one of said contact elements assigned to one of said subscriber line leads positioned in its respective contact chamber turned 180° with respect to the other contact elements for the surge arrester.

12. The protective plug of claim 1, wherein:

said internal sidewalls define said contact chambers in a triangular pattern; and said contact elements are mounted in positions turned with respect to one another such that said terminals of said surge arrester may be plugged into said clamp section of said contact elements in the plane of the central axis of the elongate side of said protective plug without the necessity of additional deformation and alignment.

13. The protective plug of claim 1, wherein:

said pairs of first contacts and said second plurality of second contacts are mounted in alignment along the length of said distributor strip in respective rows with one of said rows of said first contacts in the immediate proximity of the outer edge of the elongate side of said distributor strip; and said contact chambers are spaced and aligned with the same alignment and pattern of said pairs of first contacts and second contacts.

14. The protective plug of claim 1, wherein:

said clamp terminal of each of said contact elements comprises a section bent back upon itself to form a clamp for an inserted terminal;

said section including a bent-back leg including a recess therein at its upper portion providing sections on each side of the recess, the respective terminal being guided between said legs and through said recess to be clamped by said bent-back leg.

15. The protective plug of claim 14, wherein:

said clamp section comprises a non-resilient leg contacted by said bent-back leg and also including a complementary recess therein;

a bead is carried by said non-resilient leg adjacent said recess for guiding the respective terminal pin in the direction of the clamping point formed by the engagement of said bent-back leg with said non-resilient leg, the depth of said bead being less than the diameter of the respective terminal.

16. The protective plug of claim 2, wherein:

said clamp section of each of said contact elements extends above said retaining tabs in said slots for free access in mounting said surge arrester.

17. The protective plug of claim 1, wherein:

one of said internal walls extends through said lower housing part centrally of and parallel to said pair of spaced, opposed side walls; and said one internal wall constituting a shoulder for supporting said contact elements in addition to said retaining tabs.

18. The protective plug of claim 1, wherein:

each of said upper housing parts comprises a pair of guide members including ramp-shaped distal ends and mounted adjacent respective ones of said opposed second walls, said guide members of one of said upper parts mounted for overlapping relationship with said guide members of said other upper part when said parts are pivoted toward one another such that said ramp-shaped distal ends engage the inner surfaces of said second walls for aligning said upper parts as they are closed to form said contact chamber.

19. The protective plug of claim 1, and further comprising:

ribs extending perpendicularly relative to the longitudinal direction of said surge arrester and extending in each of said upper parts, said ribs engaging respective ends of said surge arrester for centering the same when said upper parts are closed and latched.

20. The protective plug of claim 1, wherein:

said distributor strip includes an internal shoulder adjacent each of said rectangular guide apertures; and each of said guides comprises resilient material and includes a shoulder for engaging behind the respective shoulder of the aperture receiving said guide.

21. A protective plug for a distributor strip utilized in telecommunication systems, the distributor strip being of the type having a plurality of insulation-pierce contacts aligned in parallel rows with three of such rows with a contact from each row closely located with respect to a corresponding contact of each of said other rows with a first of said rows of contacts being associated with a first line lead of each pair of line leads, the second of said rows being associated with a second line lead of the plurality of pairs of line leads and the contacts of the third row being for connection to ground, said insulation-piercing contacts mounted in and extending from a service side of a housing for connection to said subscriber line leads and including corresponding insulation-pierce contacts extending from said housing for connection to switching equipment, said protective plug comprising:

a surge arrester including a plurality of terminal pins extending therefrom;

a lower housing part including an upper end and a lower end, wall means defining a plurality of contact element chambers extending through said lower housing part and opening therethrough at said upper end and said lower end and spaced relative to one another corresponding to the spacing of said terminals of said surge arrester at said upper end and according to the spacing of associated insulation-pierce terminals extending from said service side of said distributor strip;

a plurality of contact elements each mounted in a respective contact chamber in said lower part and each including a pair of normally-closed contacts facing and extending to the respective opening at said lower end and a clamp terminal above the respective opening of the respective chamber at said upper end;

said terminals of said surge arrester received in respective ones of said clamp elements; and and upper housing part comprising a pair of sections pivoted to said upper end of said lower housing part and including side walls and peripheral walls which engage when said sections are pivoted toward one another to enclose said surge arrester, and means latching said pair of sections together.

* * * * *